US006554164B1

(12) United States Patent
Jones

(10) Patent No.: US 6,554,164 B1
(45) Date of Patent: Apr. 29, 2003

(54) FLEXIBLE PACKAGING BAG AND SUPPORT UNIT

(76) Inventor: Ronald Archibald Jones, 36 Lovell St., Stellenbosch, 7600, Western Cape Province (ZA)

( * ) Notice: Subject to any disclaimer, the term of this patent is extended or adjusted under 35 U.S.C. 154(b) by 0 days.

(21) Appl. No.: 10/019,130

(22) PCT Filed: Jun. 28, 2000

(86) PCT No.: PCT/ZA00/00117

§ 371 (c)(1),
(2), (4) Date: Dec. 27, 2001

(87) PCT Pub. No.: WO01/00504

PCT Pub. Date: Jan. 4, 2001

(30) Foreign Application Priority Data

Jun. 28, 1999 (ZA) ..... 99/4216

(51) Int. Cl.[7] ..... B65D 35/56

(52) U.S. Cl. ..... 222/105; 222/81; 222/143; 222/166

(58) Field of Search ..... 222/81, 105, 181.3, 222/185.1, 103, 95, 143, 166

(56) References Cited

U.S. PATENT DOCUMENTS 3,035,737 A * 5/1962 Speas ..... 222/105
3,239,104 A 3/1966 Scholle
4,562,940 A * 1/1986 Asphar ..... 222/81
4,699,296 A * 10/1987 Schrock, Jr. ..... 222/181.3
4,907,723 A * 3/1990 Katz ..... 222/105

FOREIGN PATENT DOCUMENTS

| | | |
|---|---|---|
| EP | 0598255 | 5/1994 |
| JP | 5331474 | 12/1993 |
| JP | 11049233 | 2/1999 |
| WO | 9217374 | 10/1992 |

* cited by examiner

*Primary Examiner*—Gene Mancene
*Assistant Examiner*—Melvin A Cartagena
(74) *Attorney, Agent, or Firm*—Stevens, Davis, Miller & Mosher, LLP

(57) ABSTRACT

A support unit is provided for a liquid filled flexible packaging bag having a length, width, and thickness, and which enables such a bag to be stored horizontally while enabling liquid contained within the bag to be withdrawn as and when required. The storage unit (1) has a support panel (2, 12, 14, 19, 26, 42) for a liquid filled flexible packaging bag which is adapted to support the packaging bag in an inclined orientation at least after a proportion of the initial content of the bag has been removed. The support panel corresponds generally in plan view to the length and width of the packaging bag and is usually located inside a flat shape of box (6, 46) capable of storage on a shelf of low height. The support panel may be arranged to move from a horizontal position to a progressively more inclined position as liquid is removed from the bag. A liquid supply system is also disclosed.

8 Claims, 4 Drawing Sheets

FLEXIBLE PACKAGING BAG AND SUPPORT UNIT

FIELD OF THE INVENTION

This invention relates to a flexible packaging bag support unit and system embodying same. More particularly, the invention relates to a support unit for flexible packaging bags containing liquids and which is particularly designed to enable available storage space to be efficiently utilized whilst the contents of the bag are consumed in a progressive manner. The invention also relates to a system of packaging liquid products in which such a support unit forms an important part.

BACKGROUND TO THE INVENTION

The packaging of liquids in flexible bags is becoming increasingly popular from various points of view. Firstly, packaging liquids in plastics bags is highly cost effective when compared to conventional rigid containers. Secondly, flexible bags having outlet valves collapse as their contents is consumed progressively over a period of time and this collapsing feature avoids the necessity for air, and thus oxygen, to enter the container to replace liquid withdrawn as is the case with rigid containers. Such oxygen invariably shortens the shelf life of the relevant liquid product by promoting oxidation which will generally result in spoilage of the liquid contents somewhat sooner than if oxygen were excluded.

Packaging of liquids in flexible bags generally assumes one of two different forms. In the one form the bag is packaged in a box in the so-called bag-in-box packaging configuration. Bags used in this type of system have an outlet valve, or an attachment base for an outlet valve, sealed, usually by welding, to the bag in a region adapted to be substantially lowermost in the operative orientation of the box. The box is usually provided with a removable or foldable panel so that the valve can project through the wall of the box for use.

This type of packaging operates extremely effectively and is ideally suited, in amongst other products, to the packaging of wine because air is excluded from the liquid inside the bag until substantially the entire contents has been withdrawn.

One problem with the bag-in-box packaging is that the bags and boxes are made with a height substantially greater than the depth or width of the package in order to ensure proper flow of liquid product out of the bottom, very much along the lines of a small tank. This shape is rather inconvenient from a storage point of view in that sufficient vertical space is not readily available in some storage situations, such as in refrigerators, for example. In such a situation generally only a top shelf has sufficient height available and then there is the problem of the box often being located at the back of the shelf thereby making access troublesome.

Also, the prefabricated bags having either a valve or an attachment base for a valve welded to the bag are relatively costly and, because of their prefabricated individual nature, are handled relatively slowly by a filling machine. Also, when the bag is totally depleted of the liquid product, not only is the bag and valve disposed of, but also the box. This represents a substantial pollution potential as well as a disposal problem.

In the second form of packaging utilizing flexible bags and which is commonly known as the "fill and seal" method, the bags themselves are formed by heat sealing the opposite walls of a tube of plastics material together at spaced intervals along the length of the tube whilst simultaneously filling the tube with liquid product. The tube may be formed as it is needed by welding two opposite edges of a strip together or it may have been blown as a tube.

This form of packaging is widely used in the dairy industry for packaging milk, in particular. The filling of these bags is extremely quick; the tubular plastics material from which the bags are formed is extremely inexpensive; and the machine which carries out filling and forming of the bags operates efficiently at high speed. Bags of packaged liquid are sold as such and the purchaser will usually cut off the corner of the bag and either pour the contents out, or the bag is supported in an open condition in a jug, for example. The resulting jug or other container has a similar disadvantage as regards storage as the bag-in-box described above.

Also, this treatment of the contents of the bag destroys the advantage achieved by the bag-in-box system where air is not able to contact the product in the bag whilst it is being progressively consumed. On the other hand, the pollution potential is substantially diminished in that only the bag need to be disposed of and no valve or box which would form an additional pollution potential or disposal problem is used at all.

OBJECT OF THE INVENTION

It is an object of this invention to provide a support unit for a flexible packaging bag filled with liquid which will enable storage thereof to be more efficient from a space point of view. It is another object of the invention to provide a system including such a support unit as a part thereof.

SUMMARY OF THE INVENTION

In accordance with this invention there is provided a support unit for a liquid filled flexible packaging bag having a length, width, and thickness, the storage unit comprising a support panel adapted to support a liquid filled flexible packaging bag with its length in a generally horizontal orientation and wherein the support panel is adapted to support the packaging bag in an inclined orientation at least after a proportion of the initial content of the bag has been removed.

Further features of the invention provide for the support panel according to the invention to correspond generally in plan view to the length and width of the packaging bag; for the panel, when in an inclined orientation, to be inclined in the direction corresponding to the length of the packaging bag with said incline being downwardly towards a front edge of panel; for the panel to have upstanding sidewalls for locating a packaging bag between them; for the panel to be supported by a generally horizontal base; and for the generally horizontal base to have surrounding sidewalls and optionally an access lid.

Still further features of the invention provide for the panel to be either fixed as regards its inclined orientation but preferably for the panel to be pivotable about its front edge between a position in which it is substantially horizontal and positions in which it is inclined; for the pivotable panel to be biased towards its uppermost inclined orientation; and for the bias to be such that with a full packaging bag positioned on the panel the panel moves from a substantially horizontal position to progressively more inclined positions, as liquid product is consumed from the bag.

The panel is conveniently supported by a base either located on, or actually forming, the bottom of a box and wherein the front of the box corresponds to the front edge of the support panel with the length of the panel extending rearwards. The front of the box has one or more apertures or removable areas through which an outlet unit incorporating a valve may pass from a bag contained within the box to the front exterior. In order to maximise storage space within a box it is preferred that the support panel be pivotable as indicated so that substantially the entire interior of the box is available for a full packaging bag whilst the support panel pivots to an inclined position under the action of a suitable bias as liquid product is progressively removed from the packaging bag. The latter action may be achieved by providing a bias chosen to move the support panel to a progressively more inclined position in consequence of the removal of weight from the bag.

Alternatively, the box could be provided with a lid that latches or clips in its closed position with the bias of the support panel being overcome by a downward force exerted on the bag by the lid. In this case the liquid product is under a small pressure created by the biasing force pushing upwardly on the product which is thus "squeezed" to some extent between the panel and lid. A further alternative in this regard is to provide the lid with an oppositely disposed "pressure" panel biased downwards and pivotable about its operatively rear edge. In the latter case the packaging bag is effectively squeezed between the two panels. These arrangements are considered to be particularly appropriate in instances in which the liquid product is rather viscous or paste like.

It will be understood that in all cases the concept of the invention is to enable packaging bags to be stored generally horizontally and preferably with their length extending rearwards relative to a shelf to thereby enable such packaging bag and support unit to be stored on shelves having a relatively small vertical space available and to thereby utilize available space more effectively. The fact that the support panel is inclined towards its front edge, at least when a proportion of the liquid in a bag supported thereon has been removed, ensures that the liquid product flows towards the front of the bag at which an outlet unit is provided.

The invention therefore provides a system in which liquid product is supplied and stored in flexible packaging bags and whereby available storage space at a user level can be more effectively used. In so doing it is of importance that flexible packaging bags be easily and cost effectively provided with an outlet unit having a control valve and the present invention is therefore preferably employed in combination with the system described in my co-pending patent application of even date which claims the same priority as this application and which is entitled "LIQUID PACKAGING SYSTEM AND COMPONENTS THEREOF".

That system includes an outlet unit having a control valve associated with it and wherein the outlet unit has an elongate outlet member which pierces a plastic wall of a packaging bag to provide an outlet valve in operative communication with liquid in the interior of a packaging bag which was previously devoid of any outlet or valve unit. It will be understood that the use of such an outlet unit greatly enhances the use of a support unit according to the present invention as the combination enables conventional plastic bags of liquids formed by a pair of spaced transverse welds across a plastics tube to be utilized for packaging a wide range of liquid products.

In order that the above and other features of the invention may be more fully understood various embodiment thereof will now be described with reference to the accompanying drawings.

DETAILED DESCRIPTION WITH REFERENCE TO THE DRAWINGS

Figure 1:
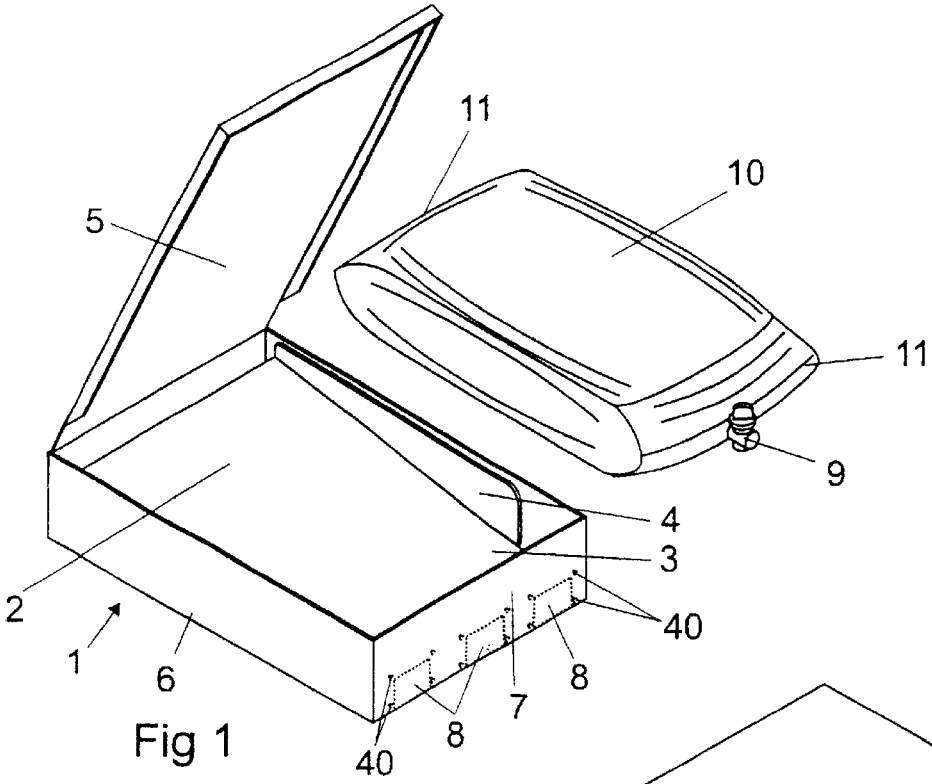
FIG. 1 is an isometric view illustrating a general form of support unit according to the invention and showing a plastics packaging bag in exploded relationship relative thereto.

In the embodiment of the invention illustrated in FIG. 1 a support unit, generally indicated by numeral (1) comprises a support panel (2) which, at least in the unstressed condition is inclined upwardly and rearwards from a front edge (3). The support panel has two opposed side walls (4), the height of which decreases from the front to the rear in order to accommodate the inclined condition of the support panel relative to a side (5) of a box (6) which neatly receives the support panel. The box (6) has a front wall (7) with three equally spaced removable areas (8) for receiving an outlet unit (9) embodying a valve attached to a plastics packaging bag (10). The dimensions of the plastic bag, in plan view, are such that it is accommodated neatly within the box in its full condition. The plastic bag (10) is preferably of the type which is formed between a pair of spaced welds (11) formed on a tube of the plastics material and defining the two ends of the plastic bag. Such a bag naturally lies flat in a horizontal position such as in the orientation illustrated in FIG. 1.

As indicated above the support panel can assume a number of different configurations, some of which will now be described as follows.

Figure 3:
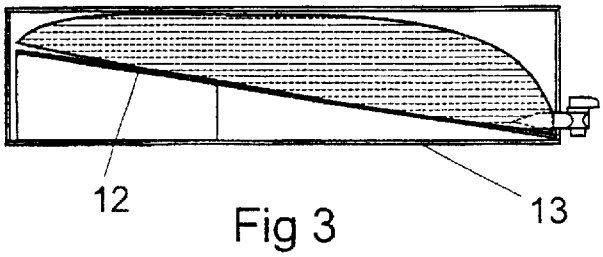
FIG. 3 is a sectional side view of a simple embodiment of the invention having a fixed inclined support panel.
Figure 4A:
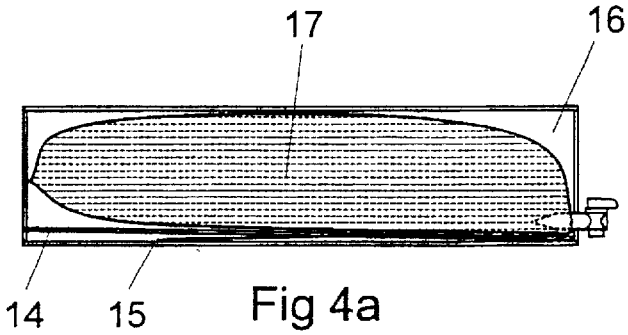
FIGS. 4*a*, 4*b*, 4*c* and 4*d* illustrate in similar sectional side view the progressive increase in inclination of the support panel in a case in which it is pivotably biased upwardly about its front edge.
Figure 4B:
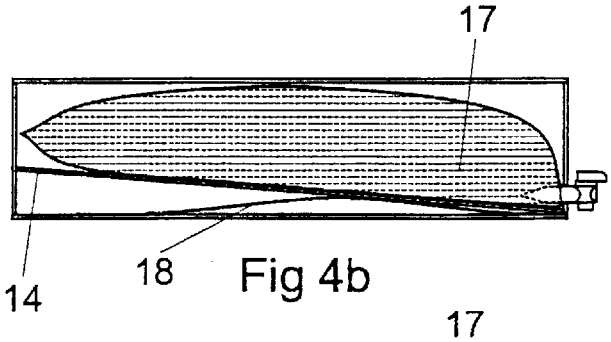
Figure 4C:
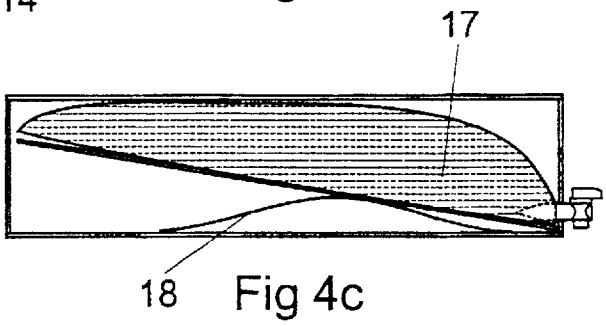
Figure 4D:
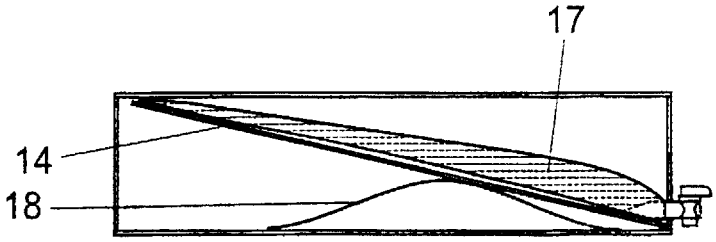

Referring firstly to FIG. 3, there is illustrated an embodiment of the invention in which the support panel (12) is fixed in its inclination relative to a box (13) in which it is located.

FIGS. 4*a* through 4*d* illustrate an embodiment of the invention in which the support panel (14) is resiliently biased to the upwardly inclined position (illustrated in FIG. 4*d*) but is moveable to a roughly horizontal position adjacent the bottom (15) of the enclosing box (16) under the weight of a full packaging bag (17). The resilient bias of the panel (14) is, in this case, such that it rises to a more and more steeply inclined position gradually as product is removed from the bag and thus through the stages illustrated in FIGS. 4*b* and 4*c*. in this particular case the biasing is illustrated as being achieved by a thin, shaped stainless steel plate (18) having the humped configuration in the relaxed condition.

Figure 5:
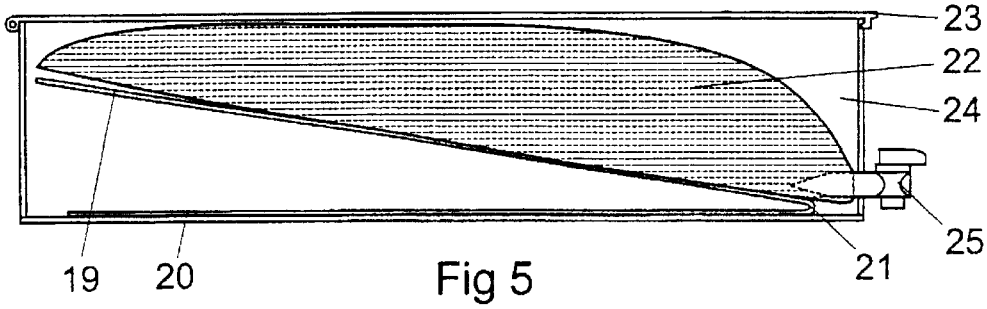
FIG. 5 is a similar and enlarged sectional side view illustrating a variation of the embodiment illustrated in FIG. 4.

FIG. 5 illustrates a further embodiment in which the support panel (19) is made integral with a base (20) to which it is connected through an acute angle at the front edge (21). In this case the biasing force is slightly greater than that necessary in the embodiment described above so that a packaging bag (22) can be gently squeezed between the support panel (19) and the lid (23) to the box (24) in which the panel and base are located. In such a case the liquid is under a slight pressure which will assist in causing the liquid to flow out of an associated outlet unit (25) on demand.

Figure 6:
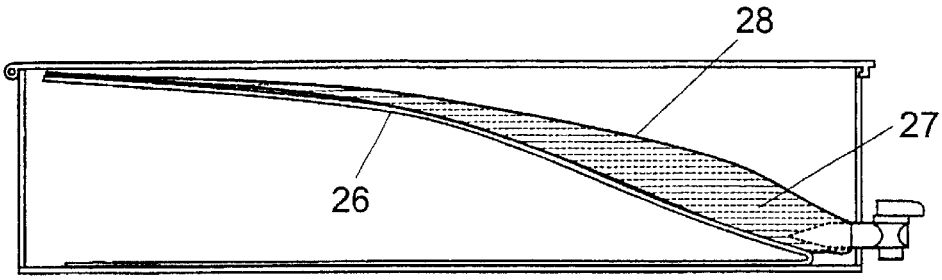
FIG. 6 is a similar view illustrating a variation of the support panel illustrated in FIG. 5.

Turning now to FIG. 6 of the drawings there is illustrated a support panel (26) having a somewhat upwardly bowed shape which is arranged to cause a small quantity of liquid (27) remaining in the packaging bag (28) to more easily accumulate in the front lowermost region of the bag.

In all cases it will be understood that, as product becomes consumed the balance will flow towards the outlet unit at the front edge of the support panel and will thereby cause the upper and rearward region of the bag to drain effectively. In this manner the entire contents of a packaging bag containing liquid product can be dispensed through an outlet unit located the front edge of the support unit. It will be understood that a flat box of this nature can be very easily accommodated on a shelf of low height as illustrated in FIG. 7.

Figure 2:
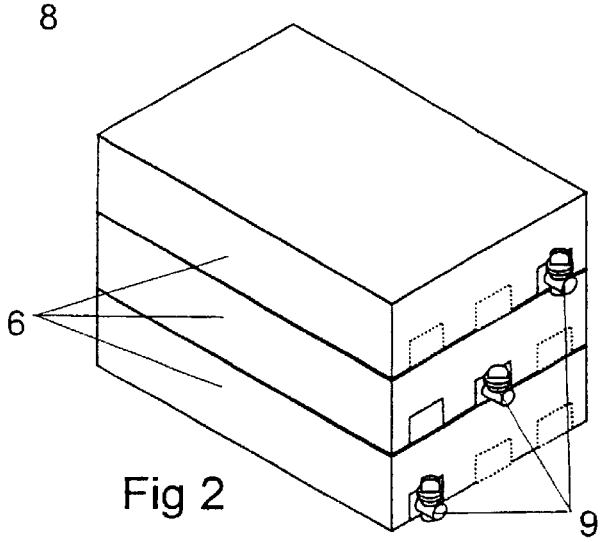
FIG. 2 shows in isometric view one configuration of a plurality of support units which is possible within the scope of this invention.
Figure 7:
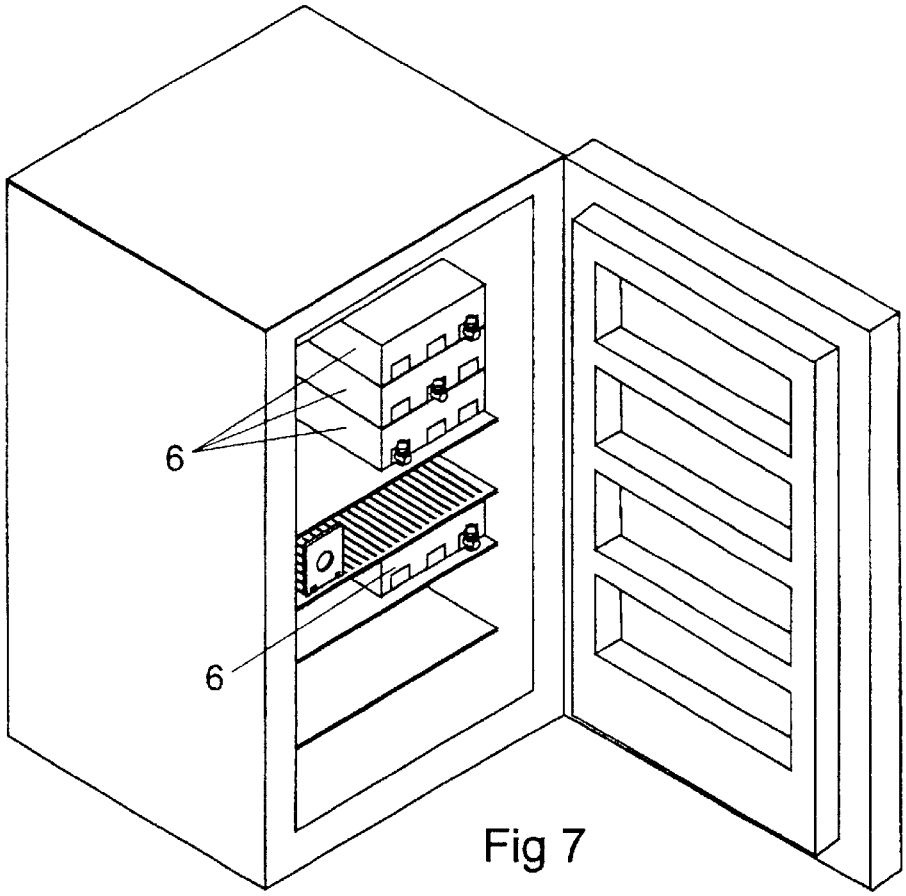
FIG. 7 is an illustration of a small refrigerator showing how space can be effectively utilized by employing support units according to the invention.

Alternatively, a number of these relatively flat boxes may be stacked one on top of the other as indicated in FIGS. 2 and 7. In this case the outlet units (9) are selectively associated with different removable areas (8) so that a staggered configuration of outlet units achieved to thereby facilitate use of each of the outlet units without interference from the others.

It will be understood that the full bags can be provided with outlet units at the factory as in the case of the bag-in-box configuration described above. However, it is preferred that the liquid filled bags be produced devoid of any outlet unit or outlet attachment base and that the outlet units described in my said co-pending patent application be employed to good effect. Simply for the sake of completeness that arrangement is described briefly herein with reference to FIGS. 8*a* through 8*d*.

Figure 8A:
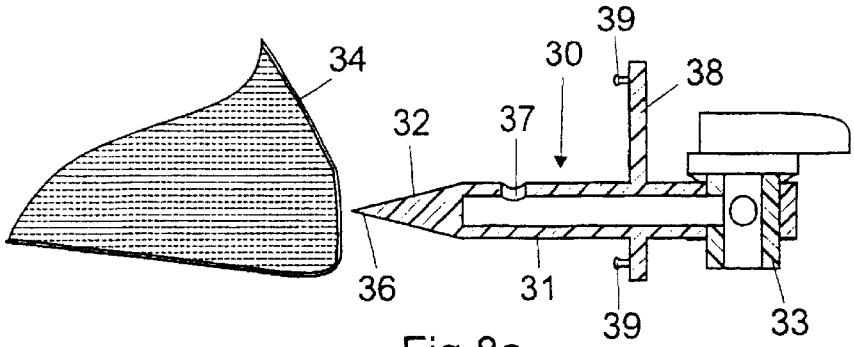
FIGS. 8*a*, 8*b*, 8*c*, and 8*d* illustrate the installation of an outlet unit relative to a full plastics packaging bag in terms of my said co-pending patent application; and, FIG. 9 is a view similar to FIG. 5 but illustrating some further alternatives including the use of a "pressure" panel as indicated above.
Figure 8B:
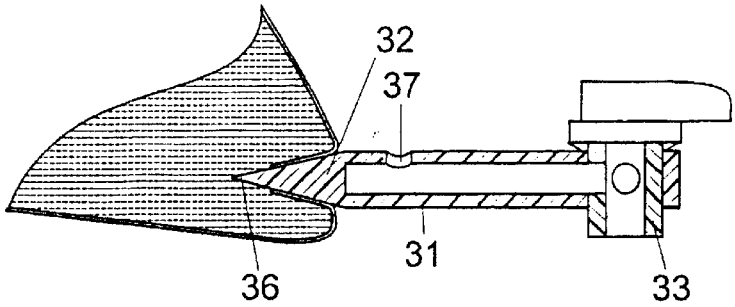
Figure 8C:
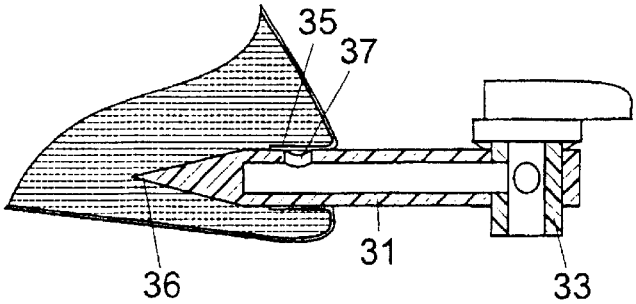
Figure 8D:
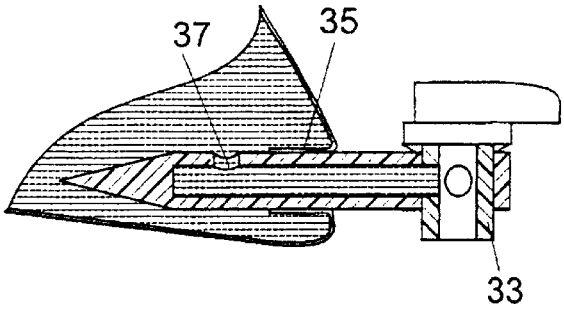

In this case an outlet unit, generally indicated by numeral (30) has an elongate tubular outlet member (31) having at one end a conical spike (32) and at the other end a closure member (33) forming a valve or tap. The plastic material from which the bag is made has physical characteristics enabling the spike (32) to be pushed inwardly into the wall (34) of the base so that a portion (5) of the wall initially tightly encircles the point (36) of the spike prior to it penetrating the wall. The outlet member is pushed inwardly through the wall through the stages illustrated in FIGS. 8*a* through 8*d* with a laterally directed aperture (37) in the operatively inner end region of the tubular outlet member ultimately becoming located on the inside of the bag as shown in FIG. 8*d*. Finally, the outlet unit also preferably includes a bracket or flange (38) (shown only in FIG. 8*a*) with projections (39) for engaging the box to hold the outlet unit relative thereto. The box could have locating perforations (40) for receiving the projections.

Apart from resulting in a substantial cost saving the latter arrangement for installing an outlet unit in a plastic packaging bag filled with liquid enables the outlet unit to be located at a chosen position in the bag, for example one corresponding to a selected area (8) of the box (6) which can be removed accordingly.

Figure 9:
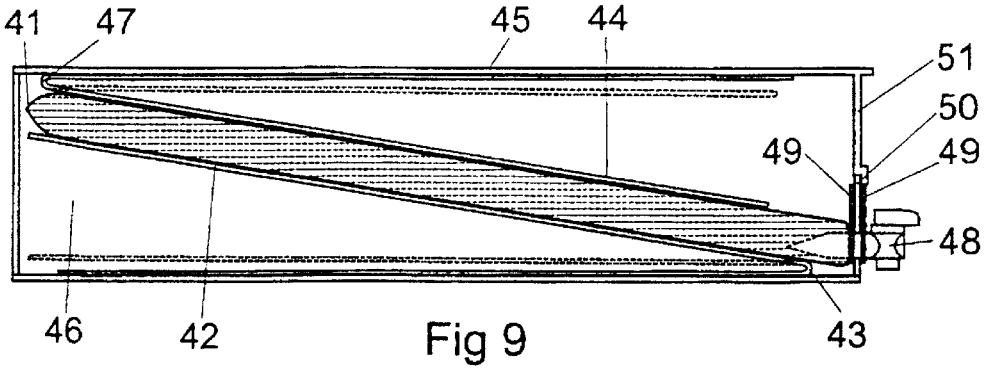

Turning now to FIG. 9 of the drawings there is illustrated a variation of the embodiment illustrated in FIG. 6 in which the bag (41) is sandwiched between a support panel (42) biased upwardly and pivotable about its forward edge (23) and a "pressure" panel (44) carried by a lid (45) of the box (46) and biased downwards.

The pressure panel is pivotable about its rear edge (47) towards the rear of the lid. The arrangement is such that the two panels remain approximately parallel, as illustrated, their most remote positions relative to each other corresponding to a full bag being illustrated in dotted lines.

FIG. 9 also illustrates an outlet unit (48) having a pair of spaced transverse flanges (49) which locate the unit relative to the front wall (50) of the box. In this embodiment of the invention recesses are provided in the edge of the front wall which extends only halfway up the height of the box with the recesses being closed at their upper ends by a downwardly extending flange (51) carried by the lid. In this embodiment of the invention the lid is held onto the box by interengaging formations (not shown) of any suitable type which require that the lid be slid onto the box in its own plane.

It will be understood that numerous variations may be made to the embodiments of the invention described above without departing from the scope hereof. Thus, for example, the configuration of the box can be varied widely and the means for biasing a movable support panel can be chosen according to circumstances and availability of materials. The invention extends to disposable boxes embodying support units according to the invention but is more particularly concerned with support units and associated boxes which are reusable and indeed substantially permanent and durable items. In the latter case the support units and boxes are constructed of materials exhibiting appropriate durability whereas in cases of disposable support units and boxes materials appropriate to disposal and which are environmentally friendly preferred.

The invention therefore provides a support unit for a flexible plastics bag of liquid product which enables effective use to be made of storage space that was not possible heretofore. Also, use of a system including the support units and outlet units as described enables the advantages of both prior art systems described above to be used to advantage.

What is claimed is:

1. A support unit for a liquid filled flexible packaging bag having a length, width, and thickness, the support unit comprising a support panel located in a box having a bottom, surrounding walls and an access lid, the support panel being adapted to support a liquid filled flexible packaging bag with its length in a generally horizontal orientation and wherein the support panel corresponds generally in plan view to the length and width of the packaging bag and is adapted to support the packaging bag in an inclined orientation at least after a proportion of the initial content of the bag has been removed with said incline being downwards towards a front edge of the panel, the support panel further being resiliently biased toward an upwardly inclined orientation so that it moves from a position in which is it positioned adjacent the bottom of the box to a progressively more inclined position as liquid is removed from a bag supported thereon.

2. A support unit as claimed in claim 1 in which the support panel, when in an inclined orientation, is inclined in a direction corresponding to the length of the packaging bag.

3. A support unit as claimed in claim 1 in which the panel has upstanding sidewalls for locating a packaging bag between them.

4. A support unit as claimed in claim 1 in which the panel is pivotable about its front edge between a position in which it is substantially horizontal and positions in which it is inclined.

5. A supported unit as claimed in claim 1 in which the resilient bias is such that with a full packaging bag positioned on the panel it is located substantially horizontally but moves from the substantially horizontal position to progressively more inclined positions, as liquid product is consumed from the bag.

6. A support unit as claimed in claim 1 in which the lid latches or clips in its closed position and the bias of the support panel is overcome by a downward force exerted on a bag by the lid.

7. A support unit as claimed in claim 6 in which a "pressure" panel pivotable about its rear edge is carried by the lid to exert a downwards pressure on a bag located on the support panel and to thereby sandwich the bag between it and the support panel.

8. A liquid product supply system in which liquid product is supplied and stored in flexible packaging bags either having or capable of receiving a valve controlled outlet unit and adapted to be used in combination with a support unit as claimed in claim 1.

* * * * *